US009975142B2

(12) United States Patent
Hwang et al.

(10) Patent No.: US 9,975,142 B2
(45) Date of Patent: May 22, 2018

(54) FLUID APPLICATOR TOOL AND METHOD OF APPLYING FLUID TO A TUBULAR MEMBER

(71) Applicant: The Boeing Company, Chicago, IL (US)

(72) Inventors: Peter K. Hwang, Mill Creek, WA (US); Charles Leroy Fisher, Lake Stevens, WA (US); Kyle Anthony Miller, Marysville, WA (US)

(73) Assignee: The Boeing Company, Chicago, IL (US)

( * ) Notice: Subject to any disclaimer, the term of this patent is extended or adjusted under 35 U.S.C. 154(b) by 0 days. days.

(21) Appl. No.: 15/139,076

(22) Filed: Apr. 26, 2016

(65) Prior Publication Data

US 2017/0304866 A1 Oct. 26, 2017

(51) Int. Cl.
*B05D 1/40* (2006.01)
*B05D 1/28* (2006.01)

(52) U.S. Cl.
CPC *B05D 1/40* (2013.01); *B05D 1/28* (2013.01)

(58) Field of Classification Search
CPC combination set(s) only.
See application file for complete search history.

(56) References Cited

U.S. PATENT DOCUMENTS 4,110,862 A 9/1978 Buzhinsky et al.
5,499,474 A * 3/1996 Knooihuizen ..... A01M 21/043 401/10
6,881,266 B1 4/2005 Daykin et al.
6,883,988 B1 * 4/2005 Brown ..... A47L 4/02 15/220.3

FOREIGN PATENT DOCUMENTS

EP 2636460 A3 1/2014

* cited by examiner

*Primary Examiner* — David Walczak
(74) *Attorney, Agent, or Firm* — Armstrong Teasdale LLP

(57) ABSTRACT

A fluid applicator tool that includes an applicator portion including a pair of arcuate clamping members that each include an inner radial portion and an outer radial portion, an absorbent media extending along the inner radial portion of each arcuate clamping member, and a hinge coupled between the pair of arcuate clamping members. The hinge is operable for rotating the pair of arcuate clamping members relative to each other for positioning between an open position and a closed position. The pair of arcuate clamping members are oriented such that a through hole is defined therebetween when in the closed position.

14 Claims, 4 Drawing Sheets

FLUID APPLICATOR TOOL AND METHOD OF APPLYING FLUID TO A TUBULAR MEMBER

BACKGROUND

The field of the present disclosure relates generally to tools and, more specifically, to a tool for use in applying primer or sealant to a tubular member in a simplified and efficient manner.

In at least some known commercial aircraft, fuel is stored in storage areas within the wings of the aircraft, and hydraulic lines extend through the storage areas for providing power to hydraulically controlled components of the aircraft. For example, components such as flaps, ailerons, and spoilers are typically controlled hydraulically. The hydraulic lines used to channel hydraulic fluid therethrough are typically formed from multiple tubular ducts coupled together in series. In some applications, wet primer or sealant is applied at joints between adjacent pairs of tubular ducts when coupling the tubular ducts together. The wet primer or sealant is typically manually applied to an exterior surface of one of the tubular ducts with a brush. However, manual application of the wet primer or sealant can be a time-consuming and laborious task. Moreover, it may be difficult for a technician to apply a uniform coating of wet primer or sealant to the exterior surface, and to prevent spillage of the wet primer or sealant during the application process.

BRIEF DESCRIPTION

In one aspect, a fluid applicator tool is provided. The tool includes an applicator portion including a pair of arcuate clamping members that each include an inner radial portion and an outer radial portion, an absorbent media extending along the inner radial portion of each arcuate clamping member, and a hinge coupled between the pair of arcuate clamping members. The hinge is operable for rotating the pair of arcuate clamping members relative to each other for positioning between an open position and a closed position. The pair of arcuate clamping members are oriented such that a through hole is defined therebetween when in the closed position.

In another aspect, a method of applying fluid to a tubular member is provided. The method includes enclosing an exterior surface of the tubular member with a pair of arcuate clamping members that each include an inner radial portion and an outer radial portion. An absorbent media extends along the inner radial portion of each arcuate clamping member. The method also includes saturating the absorbent media with the fluid, and rotating the pair of arcuate clamping members relative to the tubular member for transferring the fluid onto the exterior surface in a circumferential orientation.

In yet another aspect, a method of assembling a fluid applicator tool is provided. The method includes coupling a hinge between a pair of arcuate clamping members that each include an inner radial portion and an outer radial portion. The hinge is operable for rotating the pair of arcuate clamping members relative to each other for positioning between an open position and a closed position. The method also includes orienting the pair of arcuate clamping members such that a through hole is defined therebetween when in the closed position, and coupling an absorbent media to each arcuate clamping member, the absorbent media extending along the inner radial portion of each arcuate clamping member.

DETAILED DESCRIPTION

The implementations described herein relate to a fluid applicator tool for use in applying primer or sealant to a tubular member in a simplified and efficient manner. More specifically, the fluid applicator tool is for applying primer or sealant to an exterior surface of the tubular member in a circumferential orientation. For example, the fluid applicator tool includes a pair of arcuate clamping members and an absorbent media extending along an inner radial portion of each arcuate clamping member. The arcuate clamping members are rotatable relative to each other for positioning between an open position and a closed position. When in the open position, a gap is formed between free ends of the arcuate clamping members. The gap is sized to enable the tubular member to be inserted therethrough for positioning between the arcuate clamping members, such that fluid can be applied at a remote location along the length of the tubular member without applying the fluid to the ends of the tubular member. When in the closed position, the arcuate clamping members are positioned such that the absorbent media saturated with the primer or sealant transfers the fluid onto the exterior surface of the tubular member. The fluid applicator tool is also rotatable relative to the tubular member for uniformly applying the primer or sealant onto the exterior surface. The arcuate clamping members are then reopened for use in subsequent applications of the primer or sealant. As such, the fluid applicator tool facilitates application of primer or sealant to a tubular member quickly and easily in an efficient and ergonomic manner.

As used herein, an element or step recited in the singular and proceeded with the word "a" or "an" should be understood as not excluding plural elements or steps, unless such exclusion is explicitly recited. Furthermore, references to "exemplary implementation" or "one implementation" of the present disclosure are not intended to be interpreted as excluding the existence of additional implementations that also incorporate the recited features.

As used herein, the terms "axial" and "axially" refer to directions and orientations that extend substantially parallel to a centerline of a tubular member. Moreover, the terms "radial" and "radially" refer to directions and orientations that extend substantially perpendicular to the centerline of an applicator portion of the tool when in a closed position. In addition, as used herein, the terms "circumferential" and "circumferentially" refer to directions and orientations that extend arcuately about the centerline of the applicator portion.

Figure 1:
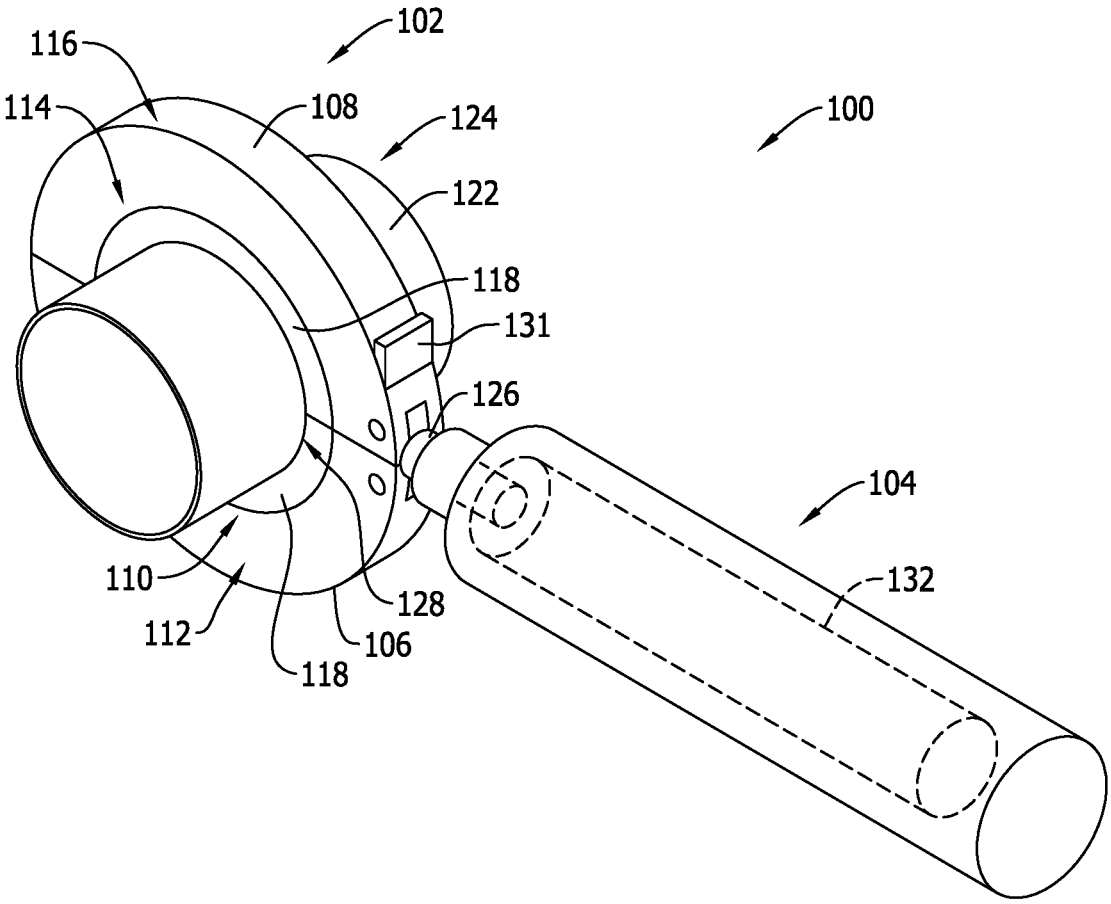
FIG. 1 is a perspective illustration of an exemplary fluid applicator tool.
Figure 2:
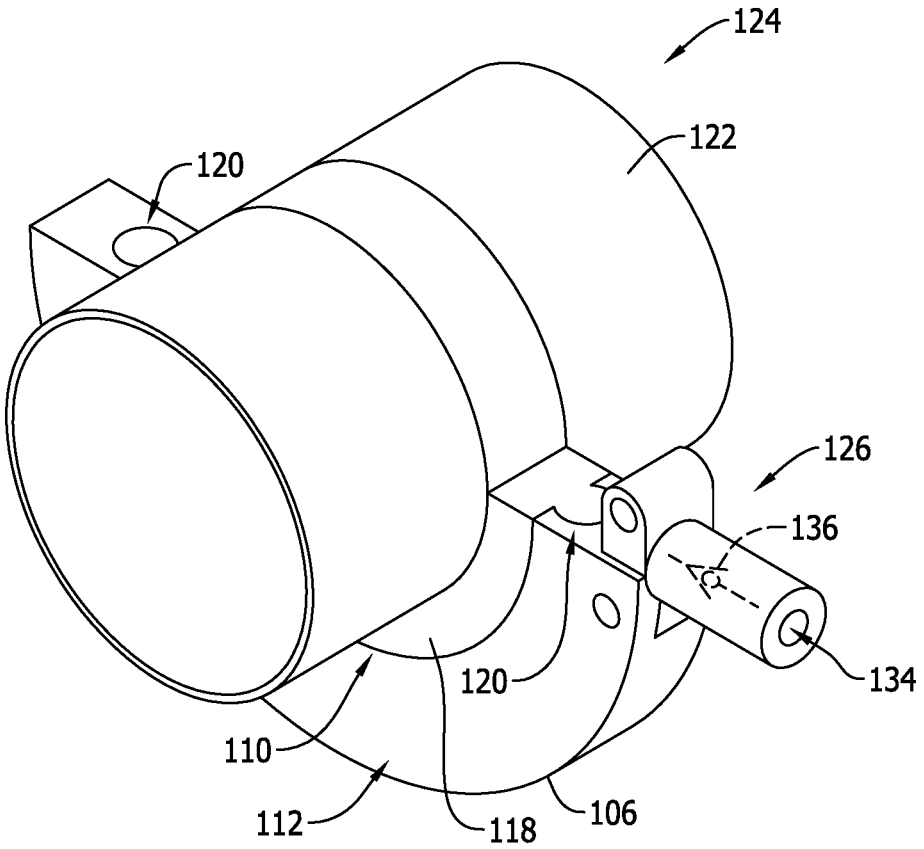
FIG. 2 is a partial cutaway illustration of a portion of the fluid applicator tool shown in FIG. 1.
Figure 3:
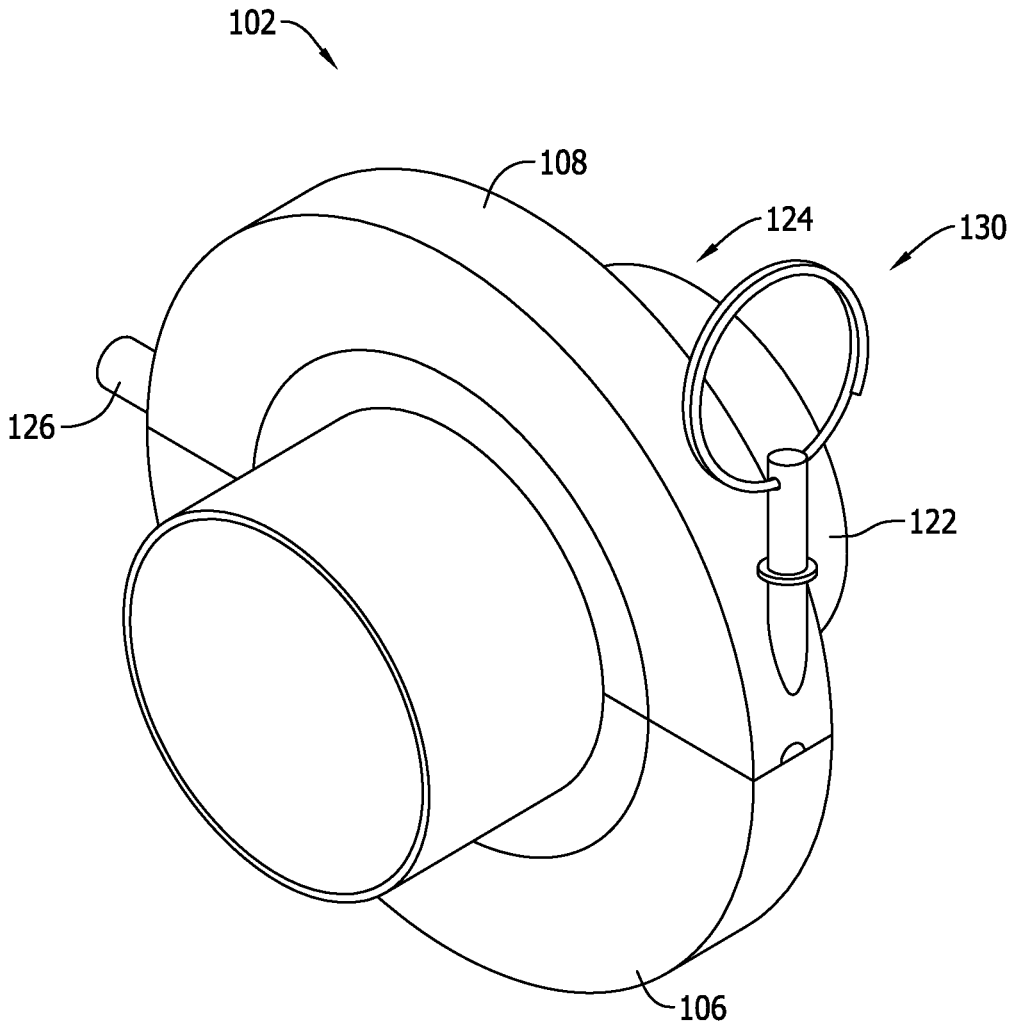
FIG. 3 is a perspective illustration of an alternative fluid applicator tool.

FIG. 1 is a perspective illustration of an exemplary fluid applicator tool 100, FIG. 2 is a partial cutaway illustration of a portion of fluid applicator tool 100, and FIG. 3 is a perspective illustration of an alternative fluid applicator tool. In the exemplary implementation, fluid applicator tool 100 includes an applicator portion 102 and a handle portion 104 coupled to applicator portion 102. Applicator portion 102 includes a pair of arcuate clamping members that each include an inner radial portion and an outer radial portion. More specifically, applicator portion 102 includes a first arcuate clamping member 106 and a second arcuate clamping member 108. First arcuate clamping member 106 includes inner radial portion 110 and outer radial portion 112, and second arcuate clamping member 108 includes inner radial portion 114 and outer radial portion 116.

Applicator portion 102 further includes an absorbent media 118 extending along inner radial portions 110 and 114 of each arcuate clamping member 106 and 108. More specifically, referring to FIG. 2, each arcuate clamping member 106 and 108 (not shown in FIG. 2) includes a recess 120 for receiving at least a portion of absorbent media 118. Recess 120 extends circumferentially about arcuate clamping members 106 and 108, and is shaped for retaining absorbent media 118 within recess 120. For example, in one implementation, recess 120 has a dovetailed cross-sectional shape for restricting radial movement of absorbent media 118 relative to arcuate clamping members 106 and 108. In an alternative implementation, absorbent media 118 is not coupled within recess 120, and recess 120 acts as a fluid plenum for evenly distributing fluid to absorbent media 118.

As will be explained in more detail below, absorbent media 118 is fabricated from any material capable of absorbing and retaining fluid therein for subsequent transfer to an exterior surface 122 of a tubular member 124. Exemplary materials for fabricating absorbent media 118 include, but are not limited to, an absorbent sponge-like material, and an array of bristles. Moreover, absorbent media 118 is formed with a predetermined width selected based on a desired width of a coating to be applied along a length of tubular member 124. More specifically, the predetermined width substantially coincides with the desired width of the coating such that applicator portion 102 is capable of applying the coating of fluid in a single rotational cycle. Put another way, the predetermined width of absorbent media 118 is selected such that applicator portion 102 is capable of applying the coating of fluid without translating applicator portion 102 relative to tubular member 124.

Applicator portion 102 also includes a hinge 126 coupled between the pair of arcuate clamping members 106 and 108. Hinge 126 is operable for rotating the pair of arcuate clamping members 106 and 108 relative to each other between an open position and a closed position. For example, as shown in FIG. 1, arcuate clamping members 106 and 108 are in the closed position. Moreover, the pair of arcuate clamping members 106 and 108 are oriented on hinge 126 such that a through hole 128 is defined therebetween when in the closed position. As will be described in more detail below, through hole 128 is sized to receive tubular member 124 therethrough such that absorbent media 118 is positioned against exterior surface 122 with an interference fit.

Moreover, in one implementation, the pair of arcuate clamping members 106 and 108 are spring-loaded for one of automatically opening or automatically closing the pair of arcuate clamping members 106 and 108. For example, the pair of arcuate clamping members 106 and 108 are spring-loaded with a torsional spring (not shown) coupled between arcuate clamping members 106 and 108 and hinge 126. Automatically closing arcuate clamping member 106 and 108 ensures applicator portion 102 remains in the closed position when an external force is not applied thereto. As such, applicator portion 102 remains enclosed about tubular member 124 during application of the fluid onto external surface 122. In such an implementation, one or both of arcuate clamping members 106 and 108 include a raised ridge 131, which provides a gripping surface for providing an external force for opening applicator portion 102.

Alternatively, referring to FIG. 3, automatically opening arcuate clamping members 106 and 108 ensures applicator portion 102 remains in the open position when an external force is not applied thereto. As such, applicator portion 102 is capable of being released from engagement with tubular member 124 single-handedly, which facilitates quick and easy operation of fluid applicator tool 100. In such an implementation, applicator portion 102 includes a latch 130 coupled between the pair of arcuate clamping members 106 and 108 for selectively retaining the pair of arcuate clamping members 106 and 108 in the closed position. As such, arcuate clamping members 106 and 108 remain enclosed about tubular member 124 during application of the fluid onto exterior surface 122. As shown, latch 130 is a quick-release pin and slot device, which enables quick and easy actuation in confined spaces.

As described above, handle portion 104 is coupled to applicator portion 102 and, more specifically, is coupled to hinge 126. In the exemplary implementation, handle portion 104 is at least partially hollow for defining a reservoir 132 for containing fluid (not shown) therein. Handle portion 104 is selectively removable from applicator portion 102 for either filling or refilling reservoir 132 with the fluid. Moreover, reservoir 132 selectively channels the fluid towards absorbent media 118 for saturating absorbent media 118 with the fluid. More specifically, as will be described in more detail below, the flow of fluid from reservoir 132 towards absorbent media 118 is controlled to avoid oversaturating absorbent media 118 with the fluid. As such, fluid applicator tool 100 is capable of extended use when applying multiple coatings of the fluid while reducing the likelihood of dropping excess fluid onto surrounding surfaces.

Referring again to FIG. 2, hinge 126 includes an inner flow passage 134 extending therethrough for coupling reservoir 132 (shown in FIG. 1) in flow communication with absorbent media 118. In an alternative implementation, handle portion 104 is coupled to one or both of arcuate clamping members 106 and 108, and arcuate clamping members 106 and 108 include a radial flow passage (not shown) for channeling fluid from reservoir 132 towards respective absorbent media 118.

In the exemplary implementation, a valve 136 is coupled between applicator portion 102 and handle portion 104 (shown in FIG. 1). More specifically, valve 136 is coupled within inner flow passage 134 and is selectively actuated for controlling the flow of fluid from reservoir 132 towards absorbent media 118. Any valve may be coupled within inner flow passage 134 that enables fluid applicator tool 100 to function as described herein. In one implementation, valve 136 is embodied as a metering valve that allows a predetermined amount of fluid to be channeled from reservoir 132 towards absorbent media 118 upon actuation. Alternatively, valve 136 is a check valve that allows fluid flow for as long as valve 136 is actuated.

In operation, valve 136 actuates in response to linear movement of handle portion 104 relative to applicator portion 102. More specifically, valve 136 actuates in response to push actuation (i.e., translating in a radial direction towards applicator portion 102) of handle portion 104. As such, fluid is provided to absorbent media 118 in an easily controlled and efficient manner.

Figure 4:
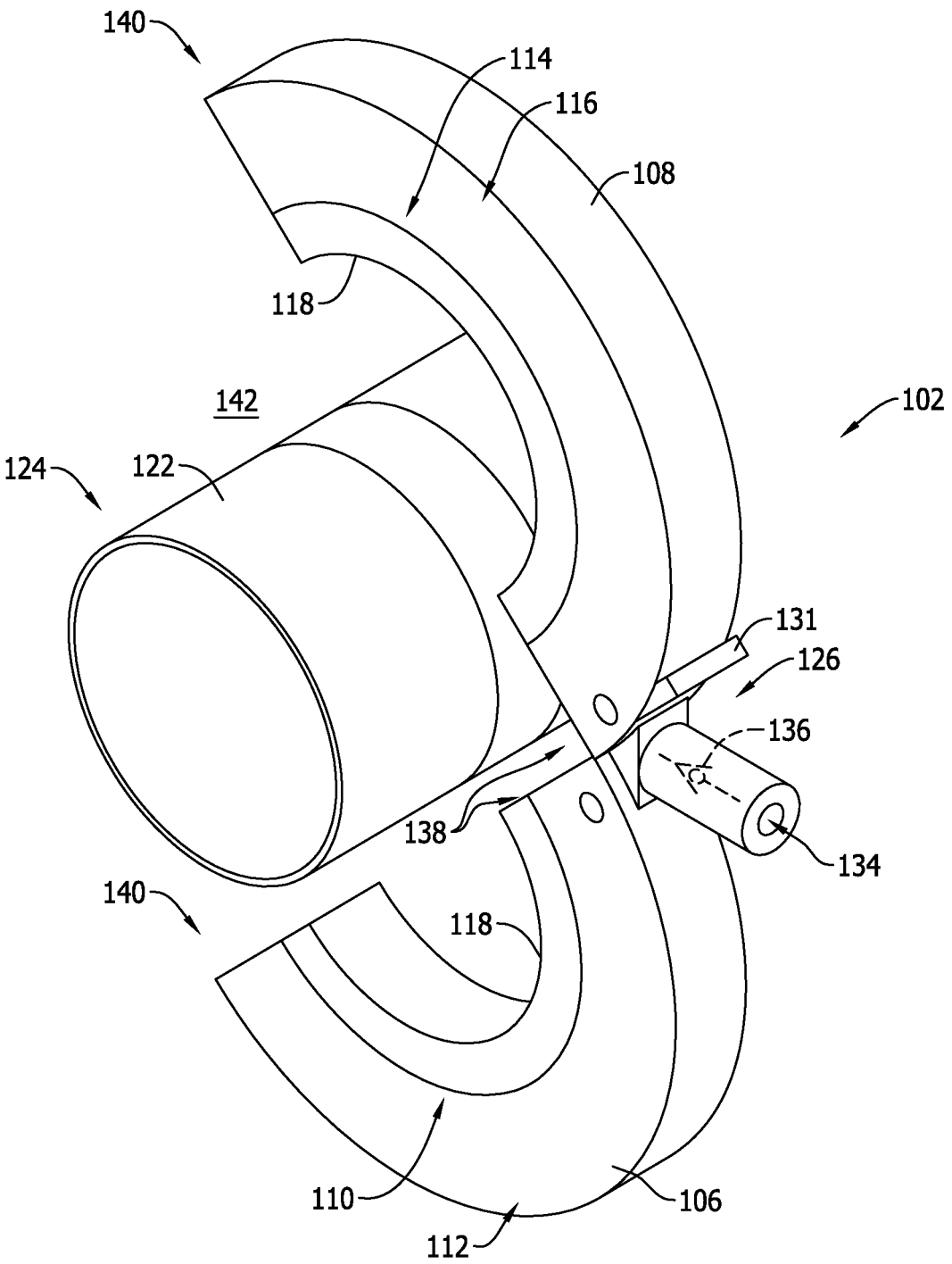
FIG. 4 is a perspective illustration of an exemplary applicator portion of the fluid applicator tool shown in FIG. 1, the applicator portion in an open position.

FIG. 4 is a perspective illustration of applicator portion 102 in an open position. In the exemplary implementation, arcuate clamping members 106 and 108 each include a first end 138 coupled to hinge 126, and a second end 140 freely rotatable about hinge 126. When in the open position, a gap 142 is defined between second ends 140 of the pair of arcuate clamping members 106 and 108. More specifically, arcuate clamping members 106 and 108 are rotatable relative to each other about hinge 126 such that gap 142 is sized to enable tubular member 124 to be inserted through gap 142 for positioning between the pair of arcuate clamping members 106 and 108. Arcuate clamping members 106 and 108 are rotatable to a degree such that absorbent media 118 does not contact exterior surface 122 during insertion of tubular member 124 through gap 142. As such, applicator portion 102 is positionable for applying fluid at remote locations along the length of tubular member 124.

A method of applying fluid to a tubular member 124 is also described herein. The method includes enclosing exterior surface 122 of tubular member 124 with a pair of arcuate clamping members 106 and 108 that each include inner radial portion 110 and outer radial portion 112. An absorbent media 118 extends along inner radial portion 110 of each arcuate clamping member 106 and 108. The method also includes saturating absorbent media 118 with the fluid, and rotating the pair of arcuate clamping members 106 and 108 relative to tubular member 124 for transferring the fluid onto exterior surface 122 in a circumferential orientation. Rotating arcuate clamping members 106 and 108 relative to tubular member 124 facilitates applying a uniform coating of the fluid onto tubular member 124

Enclosing exterior surface 122 of tubular member 124 includes hinging the pair of arcuate clamping members 106 and 108 for rotation relative to each other such that the pair of arcuate clamping members 106 and 108 are positionable between an open position and a closed position, such that gap 142 is defined between the pair of arcuate clamping members 106 and 108 when in the open position. Enclosing exterior surface 122 of tubular member 124 also includes inserting tubular member 124 through gap 142 for positioning between the pair of arcuate clamping members 106 and 108.

Moreover, enclosing exterior surface 122 of tubular member 124 includes positioning absorbent media 118 against exterior surface 122 of tubular member 124 with an interference fit. In one implementation, enclosing exterior surface 122 of tubular member 124 includes latching the pair of arcuate clamping members 106 and 108 about exterior surface 122 of tubular member 124 such that the pair of arcuate clamping members 106 and 108 are selectively retained in the closed position.

In one implementation, saturating absorbent media 118 includes selectively channeling the fluid from reservoir 132 towards absorbent media 118. Selectively channeling the fluid includes actuating valve 136 coupled between reservoir 132 and absorbent media 118, valve 136 configured to allow fluid flow therethrough when actuated.

A method of assembling fluid applicator tool 100 is also provided herein. The method includes coupling hinge 126 between a pair of arcuate clamping members 106 and 108 that each include inner radial portion 110 and outer radial portion 112. Hinge 126 is operable for rotating the pair of arcuate clamping members 106 and 108 relative to each other for positioning between an open position and a closed position. The method also includes orienting the pair of arcuate clamping members 106 and 108 such that through hole 128 is defined therebetween when in the closed position, and coupling absorbent media 118 to each arcuate clamping member 106 and 108. Absorbent media 118 extends along inner radial portion 110 of each arcuate clamping member 106 and 108.

The method further includes spring-loading the pair of arcuate clamping members 106 and 108 for one of automatically opening or automatically closing the pair of arcuate clamping members 126 and 128. The method also includes coupling handle portion 104 to one of hinge 126 or an arcuate clamping member of the pair of arcuate clamping members 106 and 108, wherein handle portion 104 is at least partially hollow for defining reservoir 132 configured to contain fluid therein. Moreover, the method includes coupling valve 136 between handle portion 104 and the one of hinge 126 or the arcuate clamping member, valve 136 configured to allow fluid flow therethrough when actuated.

The method further includes defining recess 120 in inner radial portion 110 of each arcuate clamping member 106 and 108, recess 120 configured to receive at least a portion of absorbent media 118, and shaped for retaining absorbent media 118 within recess 120. Moreover, the method includes coupling latch 130 between the pair of arcuate clamping members 106 and 108, the latch configured to selectively retain the pair of arcuate clamping members 106 and 108 in the closed position.

The method also includes sizing through hole 128 for receiving tubular member 124 therethrough, and sizing absorbent media 118 for positioning against tubular member 124 with an interference fit.

This written description uses examples to disclose various implementations, including the best mode, and also to enable any person skilled in the art to practice the various implementations, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fluid applicator tool comprising:

an applicator portion comprising:

a pair of arcuate clamping members that each comprise an inner radial portion and an outer radial portion;

an absorbent media extending along said inner radial portion of each arcuate clamping member; and a hinge coupled between said pair of arcuate clamping members, wherein each arcuate clamping member is coupled to said hinge at a discrete pivot point such that said pair of arcuate clamping members are rotatable relative to each other for positioning between an open position and a closed position, wherein said pair of arcuate clamping members are oriented such that a through hole is defined therebetween when in the closed position.

2. The tool in accordance with claim 1 further comprising a handle portion coupled to said applicator portion, wherein said handle portion is at least partially hollow for defining a reservoir configured to contain fluid therein.

3. The tool in accordance with claim 2 further comprising a valve coupled between said applicator portion and said handle portion, wherein said valve is configured to actuate in response to linear movement of said handle portion relative to said applicator portion, said valve configured to allow fluid flow therethrough when actuated.

4. The tool in accordance with claim 2, wherein said handle portion is coupled to said hinge, said hinge comprising an inner flow passage extending therethrough for coupling said reservoir in flow communication with said absorbent media.

5. The tool in accordance with claim 1, wherein each arcuate clamping member of said pair of arcuate clamping members comprises a recess configured to receive at least a portion of said absorbent media, said recess shaped for retaining said absorbent media within said recess.

6. The tool in accordance with claim 1 further comprising a latch coupled between said pair of arcuate clamping members, said latch configured to selectively retain said pair of arcuate clamping members in the closed position.

7. The tool in accordance with claim 1, wherein said pair of arcuate clamping members are spring-loaded for one of automatically opening or automatically closing said pair of arcuate clamping members.

8. A method of assembling a fluid applicator tool, said method comprising:

coupling a hinge between a pair of arcuate clamping members that each include an inner radial portion and an outer radial portion, wherein each arcuate clamping member is coupled to the hinge at a discrete pivot point such that the pair of arcuate clamping members are rotatable relative to each other for positioning between an open position and a closed position;

orienting the pair of arcuate clamping members such that a through hole is defined therebetween when in the closed position; and extending an absorbent media along the inner radial portion of each arcuate clamping member.

9. The method in accordance with claim 8 further comprising spring-loading the pair of arcuate clamping members for one of automatically opening or automatically closing the pair of arcuate clamping members.

10. The method in accordance with claim 8 further comprising coupling a handle portion to one of the hinge or an arcuate clamping member of the pair of arcuate clamping members, wherein the handle portion is at least partially hollow for defining a reservoir configured to contain fluid therein.

11. The method in accordance with claim 10 further comprising coupling a valve between the handle portion and the one of the hinge or the arcuate clamping member, the valve configured to allow fluid flow therethrough when actuated.

12. The method in accordance with claim 8 further comprising defining a recess in the inner radial portion of each arcuate clamping member, the recess configured to receive at least a portion of the absorbent media, and shaped for retaining the absorbent media within the recess.

13. The method in accordance with claim 8 further comprising coupling a latch between the pair of arcuate clamping members, the latch configured to selectively retain the pair of arcuate clamping members in the closed position.

14. The method in accordance with claim 8 further comprising:

sizing the through hole for receiving a tubular member therethrough; and sizing the absorbent media for positioning against the tubular member with an interference fit.

* * * * *